US007800316B2

(12) United States Patent
Haug

(10) Patent No.: US 7,800,316 B2
(45) Date of Patent: Sep. 21, 2010

(54) STACKED LED CONTROLLERS

(75) Inventor: Eberhard Haug, Kirchheim unter Teck (DE)

(73) Assignee: Micrel, Inc., San Jose, CA (US)

( * ) Notice: Subject to any disclaimer, the term of this patent is extended or adjusted under 35 U.S.C. 154(b) by 369 days.

(21) Appl. No.: 12/050,134

(22) Filed: Mar. 17, 2008

(65) Prior Publication Data

US 2009/0230883 A1 Sep. 17, 2009

(51) Int. Cl.
*H05B 41/36* (2006.01)

(52) U.S. Cl. ..... 315/299; 315/391; 315/361

(58) Field of Classification Search ..... 315/88–91, 315/119, 121–123, 127, 128, 185 R, 186, 315/193, 224–226, 291, 294, 297–302, 306–308, 315/310, 312, 313, 320, 323, 361, 362
See application file for complete search history.

(56) References Cited

U.S. PATENT DOCUMENTS 7,518,525 B2 * 4/2009 Chou ..... 340/815.45
2008/0122383 A1 * 5/2008 Katoh ..... 315/291

* cited by examiner

*Primary Examiner*—Douglas W Owens
*Assistant Examiner*—Jianzi Chen
(74) *Attorney, Agent, or Firm*—Patent Law Group LLP

(57) ABSTRACT

A driver for driving a plurality of light emitting diodes (LEDs) is formed of a plurality of LED controllers connected in series between a power supply and a reference voltage. Each controller drives one or more LEDs directly connected to it. Each controller has a voltage input terminal coupled to an output terminal of an adjacent upstream controller, and an output terminal coupled to the voltage input terminal of an adjacent downstream controller. Each controller has a normally-on bypass switch coupled between its voltage input terminal and the voltage input terminal of the adjacent upstream controller. The bypass switch completely bypasses the adjacent upstream controller when the adjacent downstream controller detects that its input voltage is below a threshold insufficient to drive the LED in the adjacent upstream controller. The bypass switch is turned off if the voltage is above the threshold.

22 Claims, 4 Drawing Sheets

STACKED LED CONTROLLERS

FIELD OF THE INVENTION

This invention relates to light emitting diode (LED) drivers and, in particular, to stacked LED controllers that are automatically and successively enabled based on the magnitude of the supply voltage.

BACKGROUND

FIG. 1 illustrates a conventional string of LEDs (LED1-LEDN) driven by a supply voltage source 12 and a current source. In the example of FIG. 1, the current source is a MOSFET 14 whose conductivity is controlled using a current detector 16 (e.g., a low value resistor), a controller 18, and an Iset signal. The voltage drop across the detector 16 is compared to a reference, provided by the Iset signal. The controller 18 controls the MOSFET 14 to cause the voltage drop to correspond to the Iset signal. Many other types of current controllers can be used.

The brightness of the LEDs is controlled by controlling the current through the LEDs. The voltage supplied by the voltage source 12 must be at least as great as the total voltage drop across all the LEDs plus the voltage needed for operation of the current source. The voltage drop of conventional LEDs is between 2-4 volts. Depending on the type of LED, the currents can range from 20 mA-100 mA, for low power LEDs, to 300 mA-1 A for high power LEDs.

LEDs are frequently connected in series and parallel, depending on the available power supply voltage, the required brightness, the colors to be controlled, and other factors. One increasingly popular use of LEDs is in a light fixture, driven by household current, where many LEDs are connected in series due to the high voltage. Connecting multiple LEDs in series is also common for large backlights of LCDs where high brightness is required, and where LEDs of the same color (e.g., red, green, or blue) are connected in series so they can be controlled using a single current source for each individual color. LEDs of different colors have different electrical characteristics, such as voltage drops, since they are formed of different materials.

Since LEDs of different colors and from different manufactures have different electrical characteristics, it is difficult to design an efficient LED drive system that can be used with any type of LED. Inefficiency increases when excess power supply voltage is used since the excess voltage is dropped across the current source MOSFET. The prior art systems require excess voltage when driving a serial string of LEDs since, if the supply voltage is even barely insufficient to drive the entire string of LEDs, all the LEDs are off.

In cases where the supply voltage is not regulated, such as a battery or a rectified AC signal, all the LEDs in the string will be turned off once the instantaneous supply voltage level drops below a threshold level.

It would be desirable to have an efficient LED driver for driving many LEDs, of any type, where only those LEDs that can be driven by the power supply are energized. It is also desirable to have an LED driver that can use a rectified AC voltage where all the LEDs do not turn off together once the instantaneous AC voltage drops below a threshold.

SUMMARY

In one embodiment of the invention, an LED driver system comprises a serially connected string of LED controllers. Each controller drives one or more LEDs directly connected to it. In the following descriptions, it is assumed that each controller drives one LED; however, each controller can drive any number of LEDs.

Each controller comprises a current source for its LED, a voltage detector that detects whether its input voltage exceeds a threshold needed for driving the LED, and a bypass switch controlled by the voltage detector for bypassing the adjacent upstream controller depending on the detected input voltage level. In one embodiment, the voltage detector also shunts excess current through the controller if the upstream and downstream current is greater than the current set for the LED. This allows for different LEDs connected to the stacked controllers to be driven by different currents. In contrast, the prior art series LEDs all had to conduct the same current.

If the power supply voltage is sufficiently above the combined voltage drops of all the LEDs, all of the normally-on bypass switches are turned off, so all the controllers and LEDs are energized. If the supply voltage is less than that needed to drive all the LEDs, only those controllers/LEDs that can be adequately driven by the power supply are energized, starting from the most downstream controller, and the remainder are bypassed by the switches.

Accordingly, the maximum number of LEDs connected to the stacked controllers will be energized by the available power supply voltage. This prevents total failure of the LED string for under-voltage situations and provides greater flexibility in the design of LED circuits. Further, the lighting designer does not have to provide a power supply voltage for worst case scenarios to ensure the LEDs are energized, since any power supply voltage less than required for the worst case scenario is still guaranteed to energize some LEDs. Any excess voltage above that required to drive all LEDs increases inefficiency.

In an example of the controllers being used for an LED light fixture driven by rectified but unfiltered household current, the LEDs will successively turn on, starting from the most downstream LED, and then successively turn off starting from the most upstream turned-on LED, as a result of the varying instantaneous voltage. This is a vast improvement compared to driving one or more serial strings of LEDs using a rectified AC signal, since in such a prior art configuration all the LEDs in a string would only turn on when the instantaneous voltage exceeded the combined voltage drops of all the LEDs.

Also, as compared to the prior art, the LEDs used in the present invention can be driven at a lower peak current when an AC supply is used, while achieving the same brightness level as the prior art systems with the same number of LEDs.

DETAILED DESCRIPTION

Figure 2:
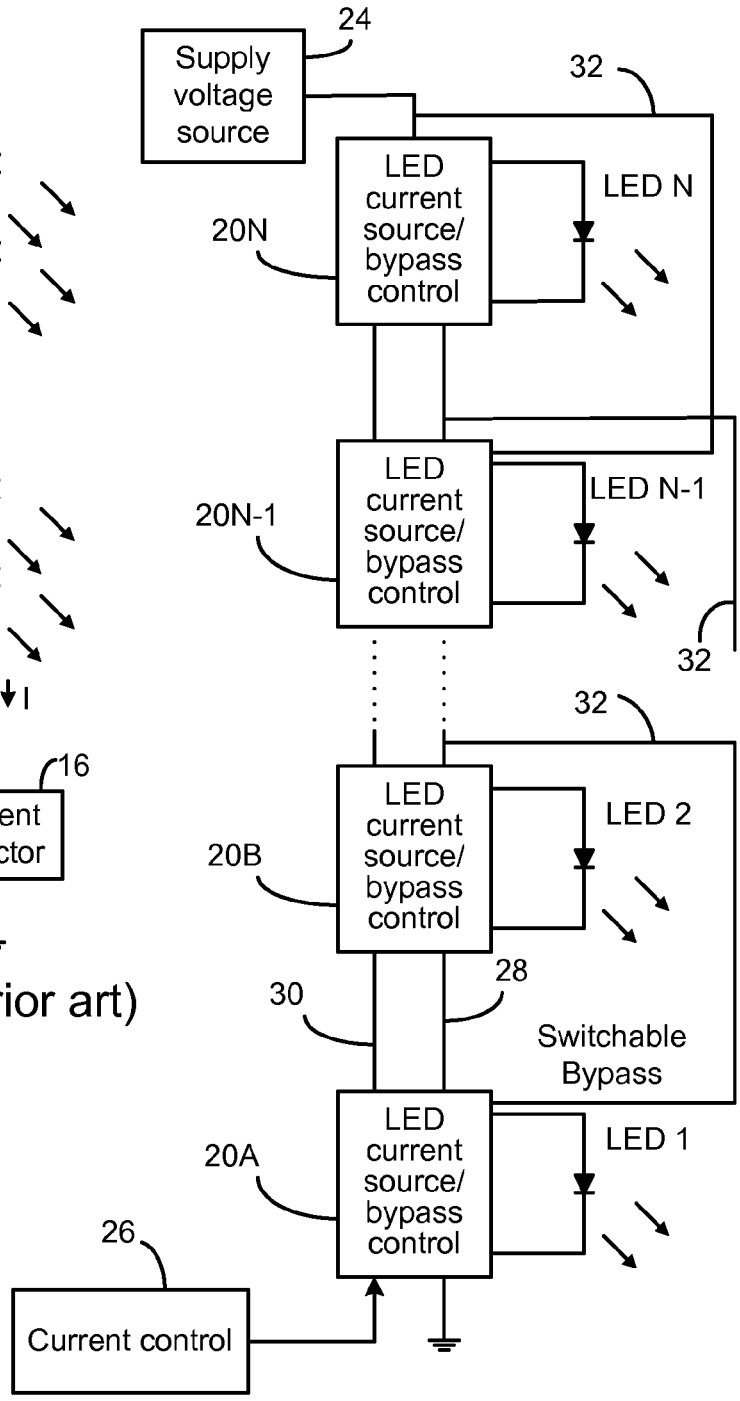
FIG. 2 illustrates a serial connection of controllers for LEDs in accordance with one embodiment of the invention.

FIG. 2 illustrates identical controllers 20A-20N, each connected to a respective LED (LEDs 1-N). There may be any number of controllers 20 and LEDs. Instead of a single LED connected to a controller 20, multiple LEDs may be connected in series and/or parallel to a single controller, and the controller circuitry would be suitable modified, such as modified to provide an increased current for driving multiple LEDs in parallel. In another embodiment, the current supplied by a controller to its respective LED may be different from the current supplied by another controller to a different type of LED.

Additionally, RGB LEDs connected to each controller 20 may be driven individually by the controller 20 to achieve virtually any color, including white, by controlling the relative brightness of each RGB color component.

The controllers 20A-20N are connected in series between a supply voltage source 24 and ground. The supply voltage may be a constant DC voltage, a rippling voltage, a rectified AC voltage, a non-regulated voltage, or any other type of voltage. Instead of ground, any reference level may be used.

An optional current controller 26 may be used if it is desired to dynamically adjust the LED currents for varying brightness rather than have fixed currents. The current control signal may be a reference signal, a resistance, a current, a voltage, a PWM signal, an analog signal, a digital signal, or any other control signal related to the currents supplied by the controllers 20 to their respective LEDs. The power supply current path is shown by vertical path 28, while the current control path is shown by vertical path 30.

A switchable bypass connection 32 is shown for selectively bypassing each controller 20, except the bottom controller 20A. Each controller includes a bypass switch for bypassing the adjacent upstream controller 20. Any number of controllers 20 except the bottom controller 20A can be bypassed if there is insufficient voltage to power all the LEDs. Depending on the available voltage, the controllers 20, starting from the bottom controller 20A, are successively energized until there is no longer sufficient voltage to drive any additional LEDs, and any upstream controllers 20 are bypassed by their bypass connection 32. For example, if the supply voltage source 24 only supplied enough voltage to drive two LEDs, then all the controllers 20 above controllers 20A and 20B would be bypassed by their bypass switch connections 32.

Each controller 20 can be formed of discrete components or any combination of integrated circuitry and discrete components, with any suitable pins for the LED connection and optional current setting signals/components. In one embodiment, all controllers 20 and all components except for the LEDs are formed in a single integrated circuit. Further, a single package may house an integrated controller and its controlled LEDs. Using advanced fabrication techniques, a controller and its LEDs may be integrated on a single chip.

An LED does not have to be coupled to every controller 20 for the circuit to operate properly, and one or more LEDs may fail without disabling the entire system.

Figure 3:
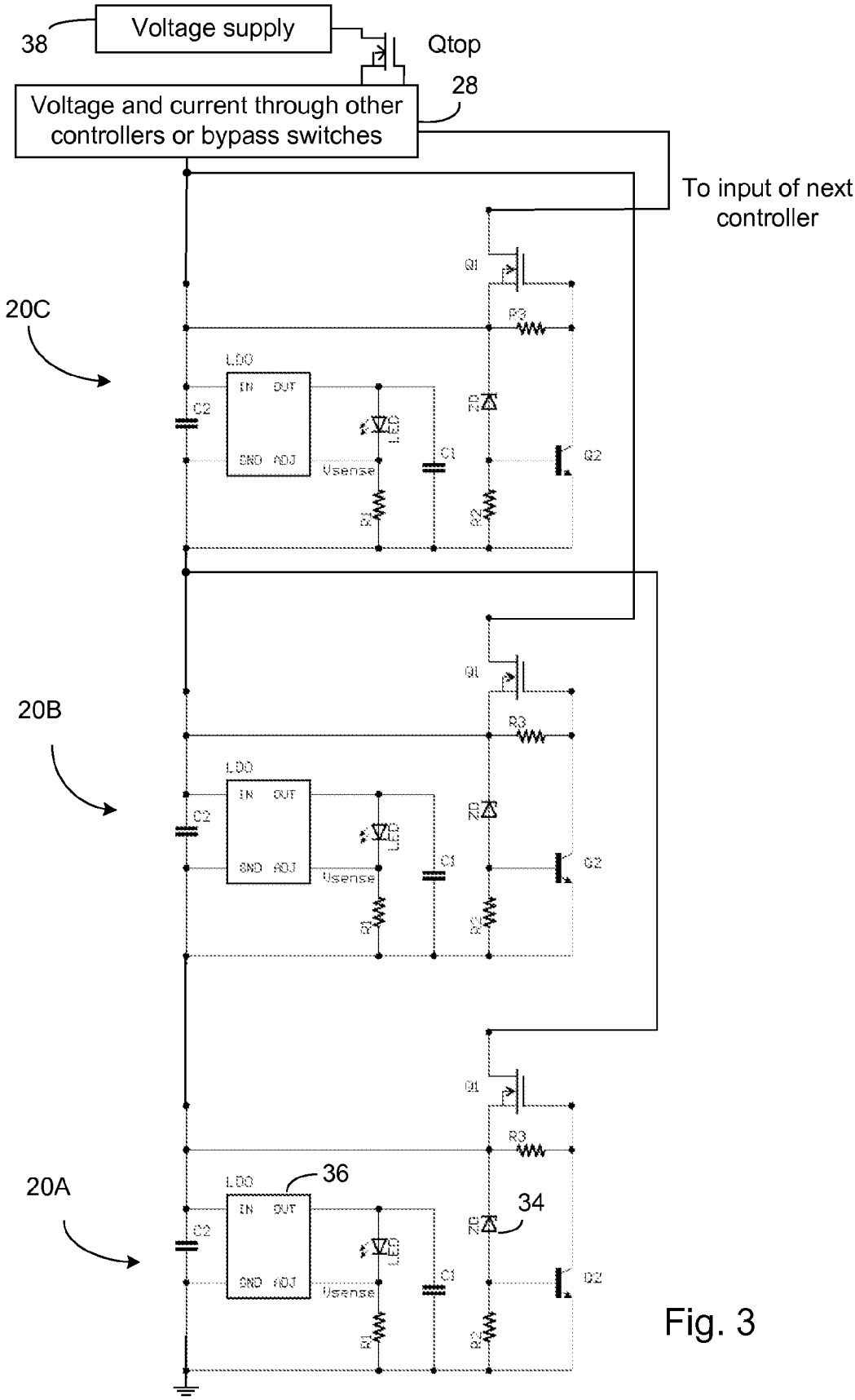
FIG. 3 illustrates the "bottom" three controllers of a serial connection of any number of controllers and the circuitry in each controller in accordance with one embodiment of the invention.

FIG. 3 illustrates the circuitry inside each controller 20, in accordance with one embodiment. There are many ways to implement the basic functions of the controller 20, and all those ways are envisioned by the present invention. The current controller 26 and current control path 30, shown in FIG. 2, is not employed in the circuit of FIG. 3 for simplicity, but providing an external circuit to control the LED current supplied by each controller in FIG. 3 is a simple task.

Only the bottom three controllers 20A, 20B, and 20C in a serial string of controllers are shown in FIG. 3. There may be any number of additional controllers, and they may be identical or supply different currents to their respective LEDs. A power supply voltage source 38 is connected to the top controller in the string, and the bottom controller is connected to ground or another reference voltage. The voltage 28 coupled to controller 20C is that voltage that has been dropped across any upstream controllers or any conducting bypass switches.

The bypass switches Q1 are normally-on types, such as n-channel depletion mode MOSFETs. An n-channel depletion mode MOSFET has a conducting n-channel when its gate is either at or above its source potential. The MOSFET turns off when the gate is more negative than the source by a threshold amount.

When a voltage is initially applied to the topmost controller in the stack (e.g., controller 20N in FIG. 2), all the bypass switches Q1 in the stack of controllers are on, so the full voltage is applied to the bottom controller 20A via the normally-on bypass switches.

A zener diode 34 in controller 20A has an on-threshold slightly higher than the voltage needed to turn on the LED in controller 20A, so the zener diode 34 does not affect the current through the LED in controller 20A.

Figure 5:
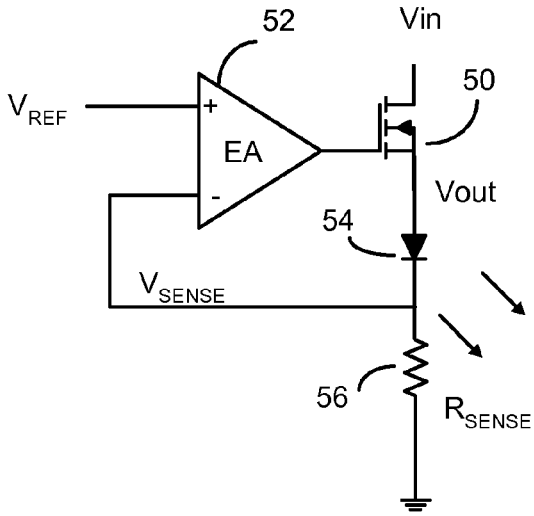
Fig. 5 (prior art)
FIG. 5 illustrates one type of current source (using a simple linear regulator) that may be used in a controller of FIG. 3.

The current through the LED in controller 20A is controlled by a low dropout regulator 36 (LDO 36) and a low value sense resistor R1. A simple LDO is shown in FIG. 5, to be discussed later. Any other current source may also be suitable. The input voltage to the LDO 36 is applied to a terminal of a pass transistor internal to the LDO 36, and the output of the LDO 36 is a second terminal of the pass transistor. The anode of the LED is connected to the output of the LDO 36. The current through the LED flows through the sense resistor R1. The voltage drop across the resistor R1 is applied to a voltage sense input of the LDO 36. The LDO 36 controls the conductivity of the pass transistor so that the sense voltage equals a fixed reference voltage, typically generated internal to the LDO 36. In this way, current through the LED is precisely set by the value of the resistor R1. If the controllers 20 are formed as integrated circuits, the resistor R1 may optionally be external to the IC package to enable the user to set the current.

Capacitors C1 and C2 are used for smoothing any voltage spikes, typically caused by the switching of the bypass switches Q1, and to prevent oscillations in the LDO 36.

The voltage applied to the controller 20A is assumed to be at least slightly higher than that needed to drive a single LED. The excess voltage applied to the controller 20A turns on the zener diode 34, which conducts a current through a resistor R2. When the voltage drop across the resistor R2 equals the Vbe of the bipolar transistor Q2, the bipolar transistor Q2 turns on. This pulls the gate of the MOSFET Q1 to a low level (lower than its source) to turn the MOSFET Q1 off, thus enabling the controller 20B. If the bipolar transistor Q2 were later turned off, a resistor R3, connected between the gate and source of the MOSFET Q1, would cause the gate and source of the MOSFET Q1 to be at equal voltages so as to turn the MOSFET Q1 back on.

The combination of the zener diode 34, resistor R2, and bipolar transistor Q2 serves as both an "excess voltage" detector to control the bypass switch MOSFET Q1 and as a shunt element to shunt any excess current around the LED to the output of the controller 20, to be further explained later. The threshold of the zener diode 34 must be such that $(V_{ZD}+V_{BE})>(V_{SENSE}+V_{LED}+V_{LDO_DROP})$, to ensure that there is sufficient voltage to turn on the LED. The zener diode 34 in a controller 20 must turn on at a voltage somewhere between the voltage needed to turn on the LED driven by the controller and the voltage needed to also turn on the LED in the adjacent upstream controller. In one embodiment, the voltage needed to turn on the zener diode 34 is about 1 volt or less above the voltage needed to turn on the LED.

Only when the MOSFET Q1 in controller 20A is turned off is current allowed to energize the upstream controller 20B. If the voltage across controller 20B is above that needed to turn on its LED, the controller 20B will energize its LED, and current will flow through the LED and through the downstream controller 20A. If the voltage across the controller 20B is sufficient to turn on its zener diode and bipolar transistor Q2, the bypass MOSFET Q1 in controller 20B will be turned off to cause the next upstream controller 20C to receive current. The same scenario applies to each controller 20 in succession towards to the power supply until there is equilibrium, where the maximum number of LEDs are driven.

In the event that the bipolar transistor Q2 in the controller 20A attempts to shut off its bypass MOSFET Q1 but there is insufficient voltage remaining to turn on the LED or zener diode 34 in the upstream controller 20B, then shutting off of the MOSFET Q1 in the controller 20A would result in no current being be passed by controller 20B to controller 20A. Therefore, in such an event, the controller 20A is inherently prevented from turning off its bypass MOSFET Q1 if the upstream controller 20B will not have enough voltage to drive its LED. This applies to any of the controllers.

As seen, the turning on of the zener diode 34 and bipolar transistor Q2 in each successive controller 20, based upon the voltage available for the upstream controllers, results in only those controllers 20 that can adequately drive their LEDs to not be bypassed by a turned off MOSFET Q1.

Figure 1:
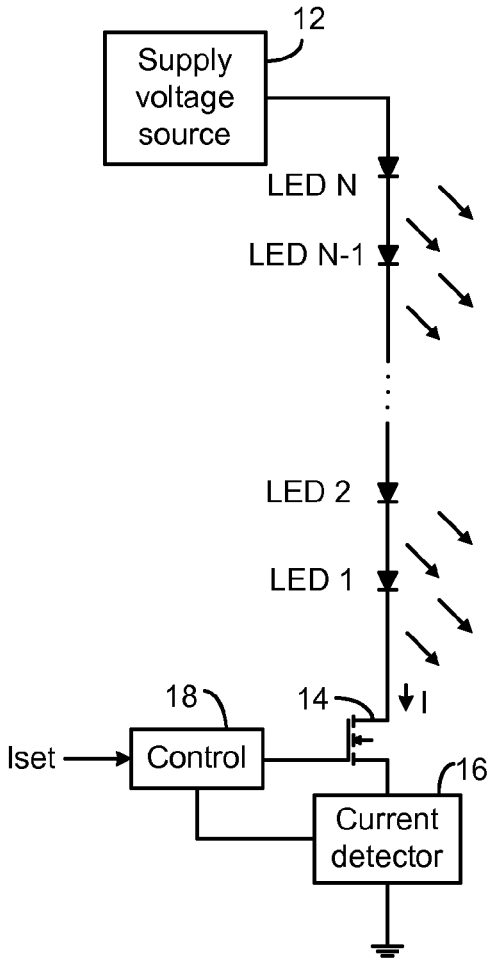
Fig. 1 (prior art)
FIG. 1 illustrates a conventional serial string of LEDs driven by a power supply and a current source.

In the event that the current setting resistor R1 in controller 20B is selected to cause the LED in controller 20B to be driven by a current that is higher than the current set for the LED in controller 20A, this excess current is shunted by the conducting zener diode 34 and base-emitter diode of transistor Q2 in the controller 20A. This shunting feature is applicable to all the controllers. Therefore, the controllers 20 allow each LED to be driven by a different current. In prior art strings of LEDs, such as shown in FIG. 1, this would be not be an available option since the same current must flow through all the LEDs connected in series. Additionally, the shunting feature allows an LED to fail as an open circuit without disabling the downstream controllers.

As an additional feature of the circuit of FIGS. 2 and 3, since the bottommost controller 20A is never bypassed and can operate at very low supply voltages, the bottommost controller 20A can be used for additional functions requiring power. For example, the controller 20 A may also dynamically control the LED current of the whole light fixture (e.g., perform the function of the current control 26 in FIG. 2). The controller 20A can control any suitable circuitry or components in addition to those shown within the controller 20A in FIG. 3.

The MOSFET Q1 of the topmost controller (shown as Qtop in FIG. 3) connected to the voltage supply 38 dissipates the difference between the total supply voltage and the sum of the controller drops, which would be slightly higher than the LED drops.

Figure 4:
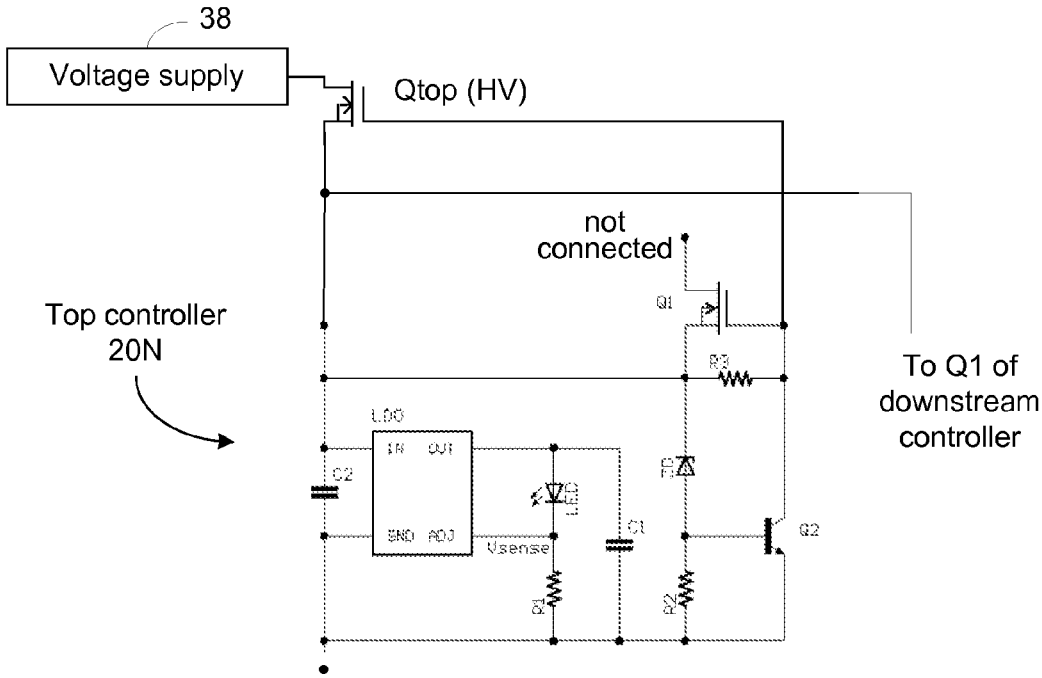
FIG. 4 illustrates a top controller connected to a power supply via a high voltage depletion mode MOSFET.

In one embodiment, shown in FIG. 4, all controllers 20 are identical, using standard low voltage technology, but the drain of the low voltage MOSFET Q1 of the top controller 20N is not connected. Instead, the MOSFET Q1 gate control terminal of the top controller 20N is connected to an external high voltage depletion mode MOSFET, labeled Qtop (HV) in FIG. 4. The MOSFET Qtop (HV) is connected between the voltage supply 38 and the upper supply input terminal of the top controller 20N. The high voltage MOSFET Qtop extends the voltage range and power dissipation capability, since it drops the voltage difference between the controllers 20 and the voltage supply 38. This also adds flexibility to the design since the MOSFET Qtop (HV) may be chosen separately from the controllers when implementing the system for a particular application.

To optimize efficiency, the voltage drops across all components should be made as low as possible while still achieving the proper function. Any of the controller components may be other than those used in the example to accomplish the basic functions of the controllers.

Using the present invention, the power supply voltage $V_{PS}$ is distributed between the active controllers 20 and the "on" bypass switches. Even an on bypass switch drops a small voltage. If M of N controllers 20 are activated, then $V_{PS}>V1+V2+\ldots+VM+(N-M)*V_S$, where V1 through VM is the voltage drop across each activated controller 20 and $V_S$ is the voltage drop across each on bypass switch.

Because of the controllers 20 being activated seriatim, based on their ability to be driven by the available voltage, virtually any number of controllers may be connected serially without the user worrying whether the power supply can drive all of the LEDs.

FIG. 5 illustrates a simple current source that can be used in each controller 20 to set the current through its LED. An LDO comprises a pass transistor 50 and an error amplifier 52. The input voltage Vin into the controller is applied to one terminal of the transistor 50, and the LED 54 is connected to the other terminal of the transistor 50. The current through the LED 54 flows through the sense resistor 56. The voltage dropped across the resistor 56 is compared with a reference voltage $V_{REF}$, and the error amplifier 52 controls the conductivity of the transistor 50 to keep the sensed voltage equal to the reference voltage. The resistor 56 "ground terminal" is just the "common voltage" of the LDO (to which $V_{REF}$ is referenced) and may not be zero volts.

Figure 6:
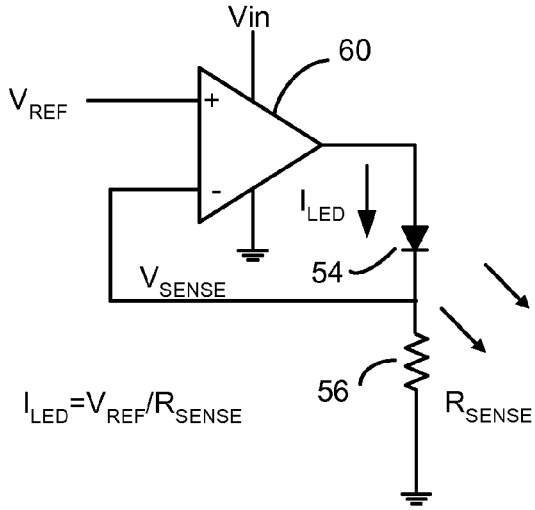
Fig. 6 (prior art)
FIG. 6 illustrates a type of generic current source that may be used in a controller of FIG. 3.

FIG. 6 is similar to FIG. 5 but envisions that any suitable circuitry may be used in amplifier 60 to generate a controlled current through LED 54. Current mirrors or other circuitry may be used in amplifier 60 to generate the output current. The current source may even be a small switching regulator.

Figure 7:
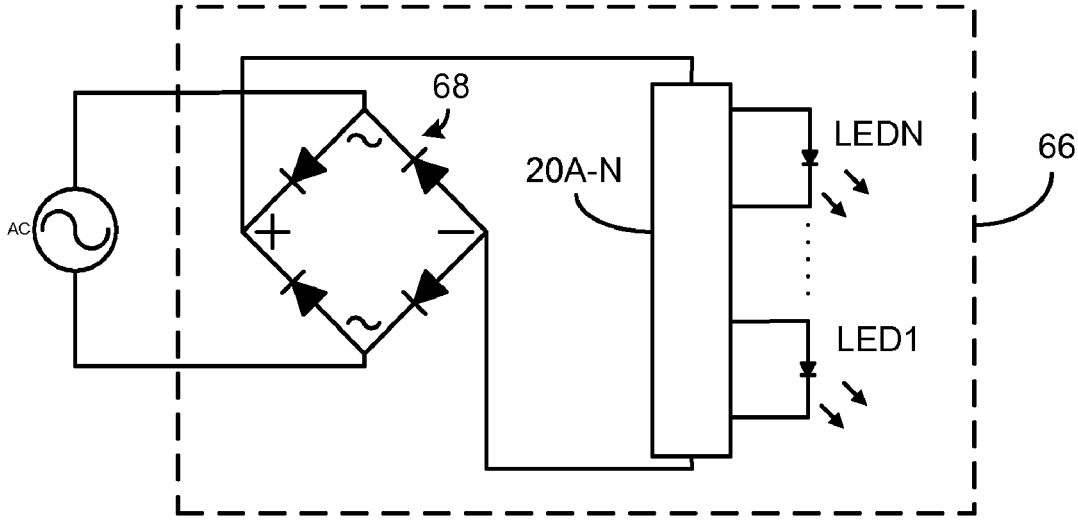
FIG. 7 illustrates an LED light fixture that is connected to standard household current.

The present invention is particularly advantageous when used in an LED light fixture driven by 120 VAC at 60 Hz (or 115 VAC/230 VAC at 50 Hz in Europe). As shown in FIG. 7, the LED light fixture 66 may use a simple full bridge rectifier 68 without filtering to create a rippling DC at 120 Hz. Not using a filter allows the fixture to be small and inexpensive since large filter capacitors are not used. The maximum number of controllers 20A-20N in series between the rectified AC terminals is that needed to drop the peak voltage of about 168 volts when all the controllers are enabled. If each controller requires 4 volts to drive its LED(s), there may be up to 42 controllers and at least 42 LEDs. There may of course be fewer or more controllers and LEDs. Each controller may drive multiple LEDs connected in series or parallel. All controller components may be mounted on a single small printed circuit board. As the voltage cyclically changes between 0 and 168 volts, the controllers will successively become enabled and disabled by the switching of the bypass switches. Thus the LED light will smoothly pulsate at 120 Hz, and only the average brightness will be perceived by the human eye. If the rectified 120 Hz voltage were used to drive a prior art type series connection of LEDs, fewer LED must be connected in series since they would have to turn on well prior to the peak voltage, and all would turn on and off at the same time. By using the present invention, more LEDs can be used in the light fixture, and the overall light output will be brighter. There will also be greater efficiency since there will be no large voltage drops using the present invention.

When using the invention with a rectified 120 Hz voltage (or 100 Hz in Europe), the LEDs closer to the neutral potential will have a higher duty cycle than the upstream LEDs, causing those downstream LEDs to appear brighter than the upstream LEDs. If this is not a desirable appearance, the LEDs may be arranged helically with the brighter LEDs toward the center to create symmetry. Alternatively, to equalize the perceived brightness of each LED, the upstream LEDs can be driven with progressively more current during each pulse of power. The product of the duty cycle times the instantaneous LED current would be the same for each LED. So, the decreased duty cycle will be offset by the increased brightness emitted during each cycle. The overall brightness of each LED will appear to be the same to the human eye.

The resistors R1 for setting currents may be individually adjustable to separately set a desired current through each LED. This may be used to create a certain overall color if the LEDs were different colors, such as RGB. In another embodiment, each LED is a white light LED, typically using a phosphor. The overall brightness level can be dynamically controlled, such as with a dimmer control, by varying a current control signal to each controller 20, as previously discussed. The circuit allows the light fixture to be dimmed using a regular AC light dimmer.

The color of LEDs changes slightly with the current through the LED. This is particularly problematic for prior art LED strings driven by an AC source, since the current through the LEDs changes as the instantaneous voltage changes once the LEDs are on. The present invention allows the current through each LED to be set to a well defined level, independent of the instantaneous supply voltage, so that the color emitted by the LED system does not change with the supply voltage.

Another application of the circuit is a voltage level detector, since the number of LEDs illuminated generally indicates the power supply voltage level.

A temperature sensor that either senses ambient temperature or the temperature of one or more of the LEDs may be incorporated into each controller to control the current to the LEDs to ensure that a threshold temperature of the LEDs is not exceeded.

Figure 8:
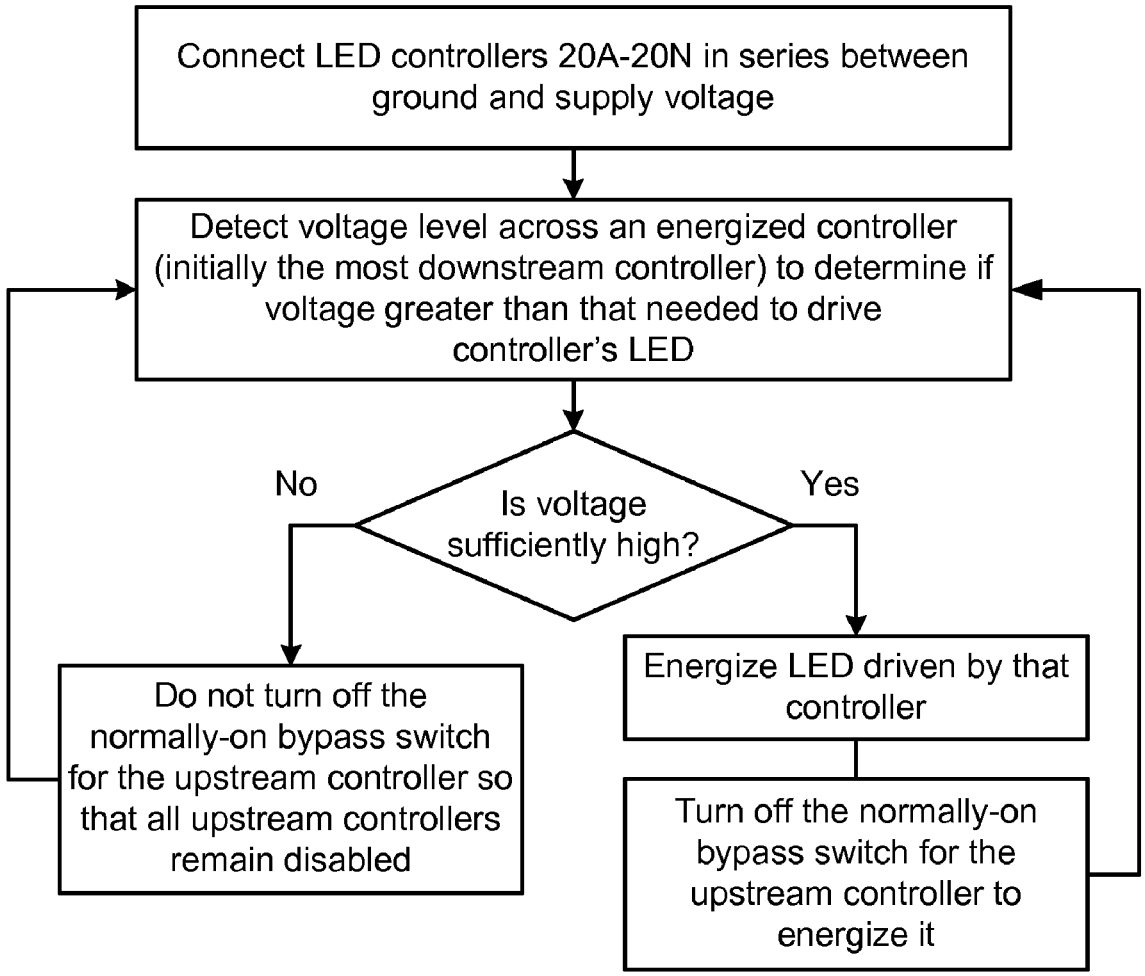
FIG. 8 is a flow chart illustrating basic steps performed by the circuit of FIG. 2, 3, or 6 for dynamically enabling only those LEDs that can be driven by the power supply voltage.

FIG. 8 is a self-explanatory flow chart identifying the basic steps performed by the circuits of FIGS. 2, 3, and 7.

Having described the invention in detail, those skilled in the art will appreciate that, given the present disclosure, modifications may be made to the invention without departing from the spirit and inventive concepts described herein. For example, a negative power supply may be used with the polarities of the components reversed. The various switches, transistors, and current sources may be any suitable types. Any component may be electrically coupled to another component using a direct wire connection, a resistance, or a nonlinear element, as appropriate for an actual implementation. Therefore, it is not intended that the scope of the invention be limited to the specific embodiments illustrated and described.

What is claimed is:

1. A light emitting diode (LED) driver comprising:

a first controller comprising:

a first voltage input terminal;

a first output terminal;

a first current source coupled to the first voltage input terminal, the first current source having at least one terminal for connection to a first LED to drive the first LED;

a first detector coupled to the first voltage input terminal for detecting whether a voltage across the first voltage input terminal and the first output terminal is above a first threshold, the first threshold being a voltage greater than that needed to turn on the first LED;

a normally-on first bypass switch having a first current handling terminal coupled to the first voltage input terminal, the first bypass switch having a second current handling terminal, the first detector being coupled to a control terminal of the first bypass switch to turn the first bypass switch off when the voltage across the first voltage input terminal and first output terminal is above the first threshold;

a second controller comprising:

a second voltage input terminal coupled to the second current handling terminal of the first bypass switch;

a second output terminal coupled to the first voltage input terminal of the first controller;

a second current source coupled to the second voltage input terminal, the second current source having at least one terminal for connection to a second LED to drive the second LED;

a second detector coupled to the second voltage input terminal for detecting whether a voltage across the second voltage input terminal and the second output terminal is above a second threshold, the second threshold being a voltage greater than that needed to turn on the second LED;

a normally-on second bypass switch having a first current handling terminal coupled to the second voltage input terminal, the second bypass switch having a second current handling terminal, the second detector being coupled to a control terminal of the second bypass switch to turn the second bypass switch off when the voltage across the second voltage input terminal and the second output terminal is above the second threshold;

whereby the first detector does not turn off the first bypass switch when the voltage detected by the first detector is below the first threshold, so that the first bypass switch substantially connects the second voltage input terminal to the first voltage input terminal to bypass the second controller, and whereby the first detector turns off the first bypass switch when the voltage detected by the first detector is above the first threshold, allowing the second controller to receive a current through its second voltage input terminal.

2. The driver of claim 1 further comprising additional LED controllers connected in series with the first controller and the second controller, each controller containing a normally-on bypass switch that is controlled to bypass an adjacent controller upstream towards a power supply if there is insufficient voltage to drive an LED in the adjacent upstream controller.

3. The driver of claim 1 wherein the first current source and the second current source comprise low dropout regulators.

4. The driver of claim 1 wherein the first detector comprises:

a zener diode; and a transistor, the zener diode being coupled between the first voltage input terminal and a control terminal of the transistor, a first current handling terminal of the transistor being coupled to the control terminal of the first bypass switch, and a second current handling terminal of the transistor being coupled to the first output terminal, wherein, when the zener diode sufficiently conducts, the transistor is turned on to turn off the first bypass switch so that the second controller is not bypassed.

5. The driver of claim 1 wherein the first detector also shunts excess current flowing into the first controller, that is not conducted by the first LED, between the first voltage input terminal and the first output terminal.

6. The driver of claim 1 wherein at least the second controller drives multiple LEDs.

7. The driver of claim 1 wherein the normally-on first bypass switch and the normally-on second bypass switch each comprise a depletion mode MOSFET.

8. The driver of claim 1 wherein currents generated by the first current source and the second current are independently settable.

9. The driver of claim 1 wherein currents generated by the first current source and the second current are dynamically controllable.

10. A driver for a plurality of light emitting diodes (LEDs) comprising:

a plurality of LED controllers connected in series between a power supply and a reference voltage, controllers in a direction of the power supply being upstream controllers, controllers in a direction of the reference voltage being downstream controllers, the controllers comprising:

a first controller connected to receive an input voltage from upstream controllers and having an output connected to the reference voltage, a second controller connected to receive an input voltage from the power supply, and one or more intermediate controllers connected between the first controller and the second controller, each intermediate controller comprising:

a first voltage input terminal;

a first output terminal coupled to a second voltage input terminal of an adjacent downstream controller;

a first current source coupled to the first voltage input terminal, the first current source having at least one terminal for connection to a first LED to drive the first LED;

a first detector coupled to the first voltage input terminal for detecting whether a voltage across the first voltage input terminal and the first output terminal is above a first threshold, the first threshold being a voltage greater than that needed to turn on the first LED;

a normally-on first bypass switch having a first current handling terminal coupled to the first voltage input terminal, the first bypass switch having a second current handling terminal coupled to a third voltage input terminal of an adjacent upstream controller, the first detector being coupled to a control terminal of the first bypass switch to turn the first bypass switch off when the voltage between the first voltage input terminal and the first output terminal is above the first threshold;

whereby the first detector does not turn off the first bypass switch when the voltage detected by the first detector is below the first threshold, so that the first bypass switch substantially connects the first voltage input terminal to the third voltage input terminal of the adjacent upstream controller to bypass the adjacent upstream controller, and whereby the first detector turns off the first bypass switch when the voltage detected by the first detector is above the first threshold, allowing the adjacent upstream controller to receive a current through its third voltage input terminal.

11. The driver of claim 10 wherein the first controller comprises:

a fourth voltage input terminal;

a second output terminal coupled to the reference voltage;

a second current source coupled to the fourth voltage input terminal, the second current source having at least one terminal for connection to a second LED to drive the second LED;

a second detector coupled to the fourth voltage input terminal for detecting whether a voltage across the fourth voltage input terminal and the second output terminal is above a second threshold, the second threshold being a voltage greater than that needed to turn on the second LED;

a normally-on second bypass switch having a first current handling terminal coupled to the fourth voltage input terminal, the second bypass switch having a second current handling terminal coupled to the voltage input terminal of an adjacent upstream controller, the second detector being coupled to a control terminal of the second bypass switch to turn the second bypass switch off when the voltage between the fourth voltage input terminal and the second output terminal is above the second threshold;

whereby the second detector does not turn off the second bypass switch, so that the second bypass switch substantially connects the fourth voltage input terminal to a voltage input terminal of an adjacent upstream controller to bypass the adjacent upstream controller, when the voltage detected by the second detector is below the second threshold, and whereby the second detector turns off the second bypass switch when the voltage detected by the second detector is above the second threshold, allowing the adjacent upstream controller to receive a current through its voltage input terminal.

12. The driver of claim 10 wherein the first detector comprises:

a zener diode; and a transistor, the zener diode being coupled between the first voltage input terminal and a control terminal of the transistor, a first current handling terminal of the transistor being coupled to the control terminal of the first bypass switch, and a second current handling terminal of the transistor being coupled to the first output terminal, wherein, when the zener diode conducts, the transistor is turned on to turn off the first bypass switch so that the adjacent upstream controller is not bypassed.

13. The driver of claim 10 wherein the first detector also shunts excess current flowing into the intermediate controller that is not conducted by the first LED.

14. The driver of claim 10 wherein the normally-on first bypass switch comprises a depletion mode MOSFET.

15. The driver of claim 10 wherein the power supply provides a rectified AC signal such that the LEDs driven by the first controller, the second controller, and the intermediate controllers are successively energized and deenergized, due to the bypass switches being successively switched, as voltage from the power supply changes between a peak instantaneous voltage and a minimum instantaneous voltage.

16. A method performed by a driver to drive a plurality of light emitting diodes (LEDs), the driver comprising a plurality of LED controllers connected in series between a power supply and a reference voltage, controllers in a direction of the power supply being upstream controllers, controllers in a direction of the reference voltage being downstream controllers, the controllers comprising a first controller connected to receive an input voltage from upstream controllers and having an output connected to a reference voltage, a second controller connected to receive an input voltage from the power supply, and one or more intermediate controllers connected between the first controller and the second controller, each intermediate controller performing the method comprising:

receiving a voltage at a first voltage input terminal coupled to an output of an adjacent upstream controller;

outputting a voltage at a first output terminal coupled to a second voltage input terminal of an adjacent downstream controller;

sourcing a current to an LED when sufficient voltage is applied across the first voltage input terminal and the first output terminal;

detecting, by a detector, whether a voltage across the first voltage input terminal and the first output terminal is above a threshold, the threshold being a voltage greater than that needed to turn on the LED;

controlling a normally-on bypass switch to turn the bypass switch off when the voltage between the first voltage input terminal and the first output terminal is above the threshold, the normally-on bypass switch having a first current handling terminal coupled to the first voltage input terminal, the bypass switch having a second current handling terminal coupled to a third voltage input terminal of an adjacent upstream controller, whereby the detector does not turn off the bypass switch when the voltage detected by the detector is below the threshold, so that that the bypass switch substantially connects the first voltage input terminal to the third voltage input terminal of the adjacent upstream controller to bypass the adjacent upstream controller, and whereby the detector turns off the bypass switch when the voltage detected by the detector is above the threshold, allowing the adjacent upstream controller to receive a current through its third voltage input terminal.

17. The method of claim 16 further comprising:

shunting excess current flowing into the intermediate controller that is not conducted by the LED between the first voltage input terminal and the first output terminal.

18. The method of claim 16 wherein the normally-on bypass switch comprises a depletion mode MOSFET.

19. The method of claim 16 wherein sourcing a current to an LED comprises independently setting a current generated by a current source to drive the LED to achieve a desired brightness level.

20. The method of claim 16 wherein sourcing a current to an LED comprises dynamically controlling the current.

21. The method of claim 16 wherein there are at least two intermediate controllers in the driver coupled in series.

22. The method of claim 16 wherein the power supply provides a rectified AC signal such that the LEDs driven by the first controller, the second controller, and the intermediate controllers are successively energized and deenergized, due to the bypass switches being successively switched, as voltage from the power supply changes between a peak instantaneous voltage and a minimum instantaneous voltage.

* * * * *